US006859984B2

(12) United States Patent
Dinet et al.

(10) Patent No.: US 6,859,984 B2
(45) Date of Patent: Mar. 1, 2005

(54) METHOD FOR PROVIDING A MATRIX ARRAY ULTRASONIC TRANSDUCER WITH AN INTEGRATED INTERCONNECTION MEANS

(75) Inventors: Dominique Dinet, Pont de Ruan (FR); Leong Ratsimandresy, Luynes (FR); Rémi Dufait, Tours (FR); An Nguyen-Dinh, Valleres (FR); Aimé Flesch, Andrésy (FR)

(73) Assignee: Vermon, Tours Cedex (FR)

( * ) Notice: Subject to any disclaimer, the term of this patent is extended or adjusted under 35 U.S.C. 154(b) by 70 days.

(21) Appl. No.: 10/234,338

(22) Filed: Sep. 5, 2002

(65) Prior Publication Data

US 2004/0048470 A1 Mar. 11, 2004

(51) Int. Cl.[7] ..... H04R 17/00

(52) U.S. Cl. ..... 29/25.35; 29/593; 29/594; 29/743; 29/760; 29/417; 310/326; 310/327; 310/367; 451/55

(58) Field of Search ..... 29/25.35, 417, 29/593, 594, 743, 760; 310/326, 327, 367, 36; 451/55

(56) References Cited

U.S. PATENT DOCUMENTS 4,101,795 A * 7/1978 Fukumoto et al. ..... 310/336
5,267,221 A * 11/1993 Miller et al. ..... 367/140
5,427,106 A * 6/1995 Breimesser et al.
5,559,388 A * 9/1996 Lorraine et al. ..... 310/334
5,855,049 A * 1/1999 Corbett, III et al.
5,894,646 A * 4/1999 Hanafy et al. ..... 29/25.35
6,341,408 B2 * 1/2002 Bureau et al.
6,546,803 B1 * 4/2003 Ptchelintsev et al. ..... 73/632

FOREIGN PATENT DOCUMENTS

FR 2 756 477 * 6/1998
JP 63276399 A * 11/1988 ..... H04R/17/00
JP 8-289398 * 11/1996

OTHER PUBLICATIONS

"The influence of constructional parameters on the practical performance of 1–3 piezocomposite transducers"; Reynolds, P.; Hyslop, J.; Hayward, G.; Ultrasonics Symposium, 1996. Proceedings., 1996 IEEE, vol.: 2, Nov. 3–6 1996; pp. 967–97 vol. 2.*

* cited by examiner

*Primary Examiner*—Paul Kim
(74) *Attorney, Agent, or Firm*—Stites & Harbison PLLC; Ross F. Hunt, Jr.

(57) ABSTRACT

A method is provided for producing a matrix array ultrasonic transducer having an integrated interconnection assembly. A piezoelectric member, formed by a plurality of individual elemental transducers arranged in M×N matrix configuration, is provided and an interconnect interface device is joined to the rear face of the piezoelectric member. A plurality of printed circuits are then attached to the interconnect device so as to enable the resultant transducer array to be electrically connected to an external cable. The interconnect device is formed by an insulator member having dimensions in accordance with those of the piezoelectric member. A drilling operation is performed on the insulator member to form a corresponding array of through holes. The insulator member is then metallized and a resin used to provide filling of the through holes. Grooves are formed in at least one face of the insulator for receiving the printed circuits.

12 Claims, 5 Drawing Sheets

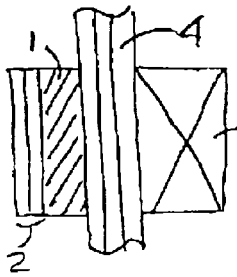
FIG. 1A
PRIOR ART
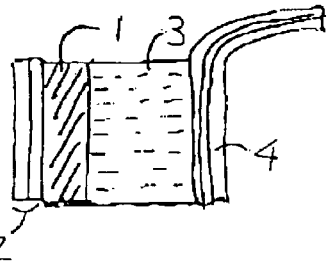
FIG. 1B
PRIOR ART
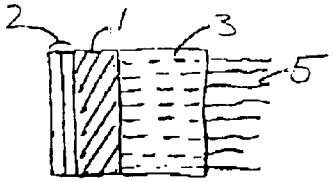
FIG. 1C
PRIOR ART
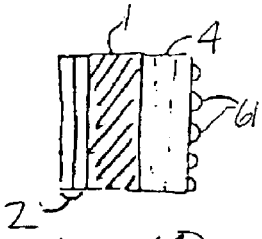
FIG. 1D
PRIOR ART
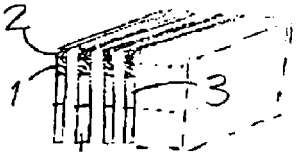
FIG. 1E
PRIOR ART
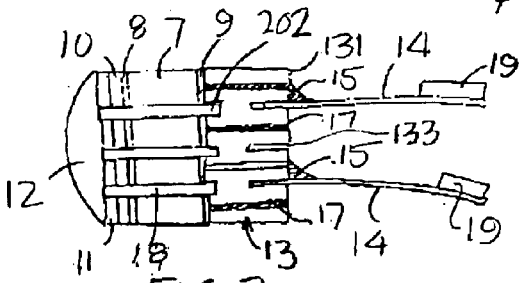
FIG. 2
FIG. 3A
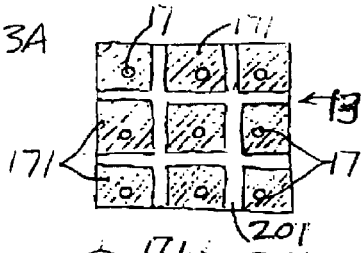
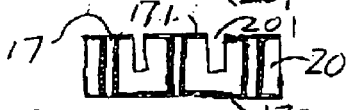
FIG. 3B
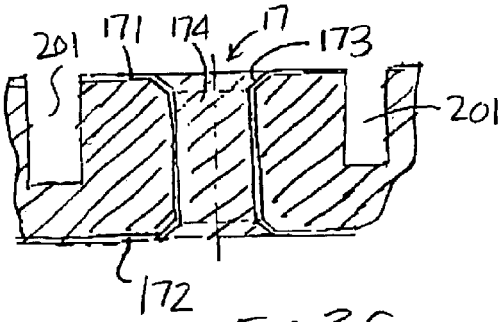
FIG. 3C
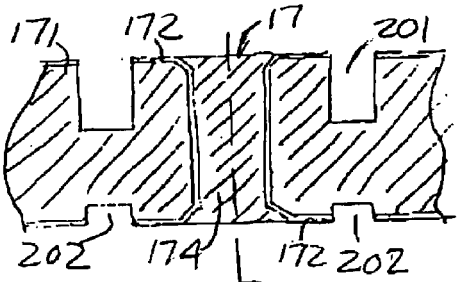
FIG. 3D FIG. 8
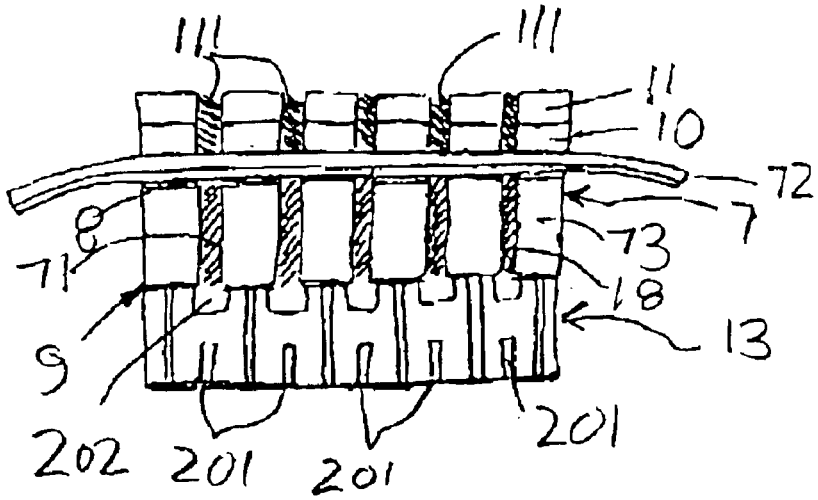
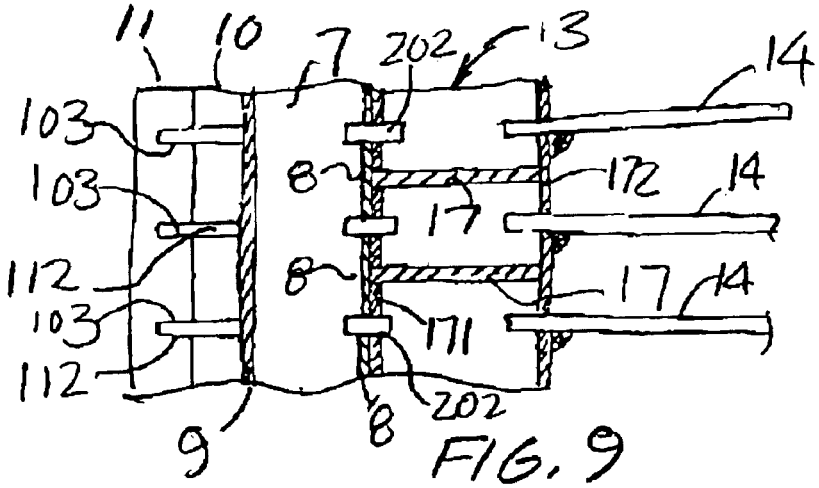
FIG. 9
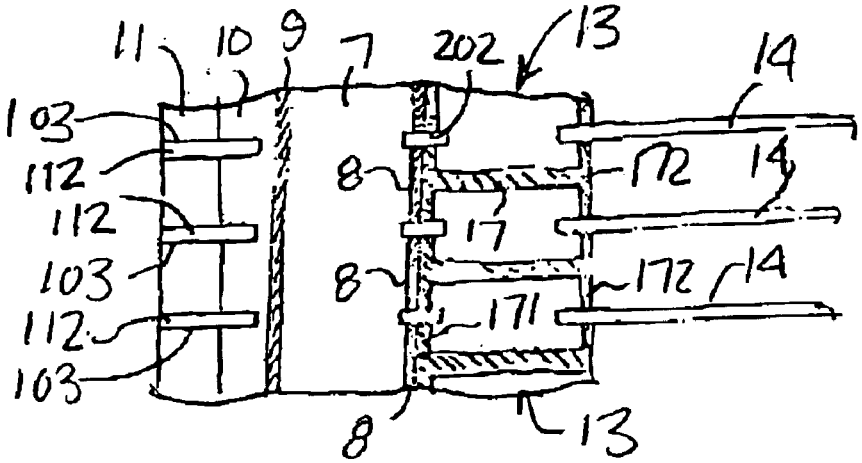
FIG. 10

FIG. 11 A
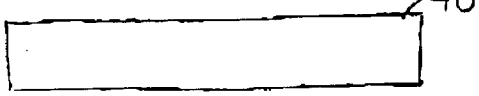
FIG. 11B
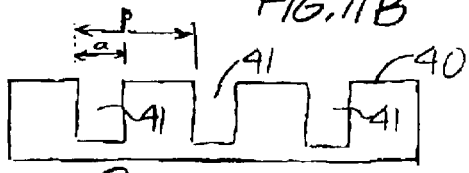
FIG. 11C
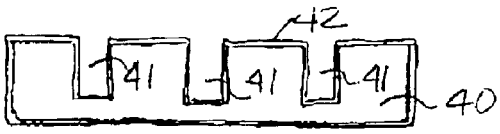
FIG. 11D
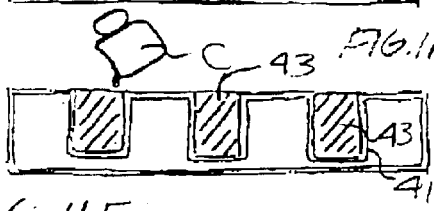
FIG. 11E
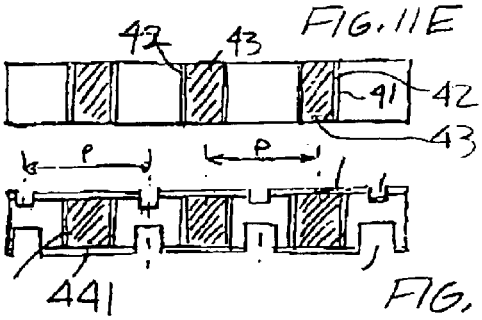
FIG. 11F
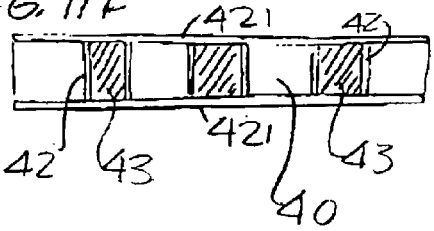
FIG. 11G
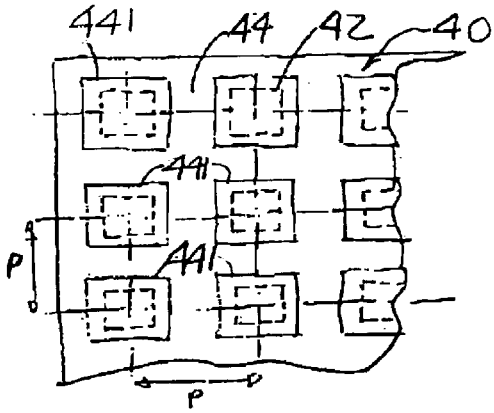
FIG. 12
FIG. 13
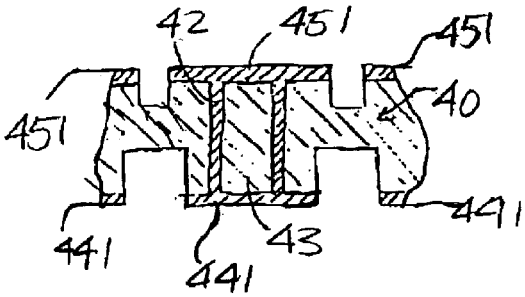
FIG. 14
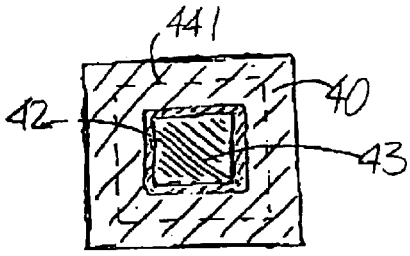

METHOD FOR PROVIDING A MATRIX ARRAY ULTRASONIC TRANSDUCER WITH AN INTEGRATED INTERCONNECTION MEANS

FIELD OF THE INVENTION

The present invention relates to methods of manufacturing ultrasonic matrix array transducers and, more particularly, to methods of providing electrical contacts on the piezoelectric members of such transducers in a manner which affords improved acoustic performance. The present invention also relates to methods of making electrical ground planes for ultrasonic matrix array transducers which enable the transducers to be manufactured in a cost effective way.

RELATED ART

Matrix arrays for medical applications are one of the newest developments in the field of ultrasonic imaging transducers. Such arrays are formed by the assembly of a plurality of small square vibrator elements generally disposed on a flat surface and arranged in N×N or M×N matrix. Each vibrator element or vibrator is individually addressed, through the use of a digital beamformer, in order to provide electronic scanning of a surface or volume. In the standard modes of operation, the matrix transducer is driven by selecting a group of vibrators to form a linear aperture wherein adjacent vibrator elements are electronically phase shifted, as in conventional linear phased array transducers. When rendering of a volume image is desired, the linear aperture is either rotated or caused to slide or be swept by activating the other vibrators on the surface of matrix. Because vibrators are electrically independent and digital processing of signals from the transducers is not time consuming, volume information can be gathered almost simultaneously, thereby enabling real time 3D rendering of images.

In order to achieve quality images and acoustic pattern steering at a desirable angle, a matrix array transducer must be designed with an elementary pitch as small as half of the wavelength of operating frequency, meaning that, for a 3 MHz transducer operating in water, a pitch as small as 256 $\mu$m is required. Such a small pitch, when strictly adhered to, yields high acoustic performance but also results in a number of construction difficulties, particularly with respect to vibrator interconnection and ground electrode distribution. Because the number of transducer elements of the matrix is equal the square of those in equivalent 1D linear phased array device, a 9,216 (96×96) element matrix array transducer can be considered to have typical specifications. Moreover, as is well known in the art, a slotted transducer must have the elements thereof provided as independent vibrators so that electromechanical cross coupling is reduced to a minimum. The best way to obtain a high quality array transducer is to perform cutting through the thickness of the transducer in order to minimize plate modes which are a source of inter-element cross coupling and the deterioration of the elementary acceptance angle.

Currently, several different methods of making high density matrix transducers have been developed. Most of these methods are based on a N×M matrix shape where the final objective is to provide 3D rendering functionalities. Before describing the current methods being used in making matrix array transducers, it is important to consider the methods employed in making linear phased arrays. In practice, a conventional linear phased array or slotted array is obtained by dicing a piezoelectric plate to form small and narrow elements which are connected to a transmission line to provide connection to the system. The interface between the active or "hot" electrode of an individual piezoelectric transducer element is provided either by a flexible circuit disposed between the piezoelectric element and a backing layer or by a rigid circuit which is wire soldered to the piezoelectric element or by a connector backing which is pressure bonded onto the piezoelectric element and which comprises conductive via extending from one end of the backing to the other end. The front electrode of the piezoelectric element has a common connection to the other elements and, in this regard, is connected to the same ground. Because the transducer array is split only in one direction, connecting the ground to the front electrode is quite an easy task for those skilled in this art.

Turning now to transducer matrix arrays, the biggest difference from linear arrays is the obvious one, i.e., that, in matrix arrays, the transducer elements are arranged in the two orthogonal (X-Y) directions of the array. As a consequence, previous methods of connecting the transducer elements which were straightforward for linear arrays are no longer so because of the intricate connections that are necessary and thus making the proper connections requires the use of unusual components or techniques. At the early development stage of matrix arrays, a direct wiring method was attempted on the rear face of the piezoelectric member, wherein each element is soldered to a single wire, and the wires are then extended through the backing member and finally connected to external coaxial cables. This method has rapidly been abandoned due to lack of reliability thereof, and the lack of repeatability with respect to the performance of the transducers. Further, several weeks of intensive labor were necessary to produce a single transducer array.

A second method for producing, at a reasonable cost, matrix transducer arrays involves the use of multilayer flexible printed circuits (MLFC) assembled to the rear face of the piezoelectric member. A MLFC device is designed with several layers of flexible (flex) circuits wherein each elementary transducer contact is connected to a via so as to extend externally. The stacking of printed circuits greatly increases the thickness of the device and acoustic artifacts are encountered.

With the purpose of overcoming the previously mentioned artifacts originally from the interconnect circuits, attempts have been carried out using conductive backing blocks which are assembled on the piezoelectric member without intermediate circuits. The backing member is manufactured as a high density multi-pin connector where each pin is spaced from the other by the pitch of array. Such method is described in U.S. Pat. No. 6,341,408 to Bureau and Gelly wherein a method for making a conductive backing for a matrix transducer is disclosed. The method includes the steps of stacking a plurality of substrates having a plurality of conductive tracks, filling a cavity formed by the substrates with a hardening resin, cutting the region of the resin-filled cavity perpendicularly to the conductive track, metallizing the surface, assembling a piezoelectric member to the metallized surface and cutting the piezoelectric member into electrically independent elements. Such a method is difficult to carry out because the stacking of hundreds of substrates is not an easy task and the necessary tolerances with respect to maintaining contact position cannot be reliably achieved.

Another method of making matrix array transducers consists of attaching all of the electronic circuitry necessary to the excitation and reception functions of the transducer immediately underneath the piezoelectric member and integrating this circuitry into a very compact circuit. Such an approach simplifies the fabrication process for the transducer, but, however, increases the reverberations in the pulse response due to the IC being directly attached.

U.S. Pat. No. 5,427,106 to Breimesser et al discloses a matrix configuration wherein, in order to simplify the interconnections of single elements of the matrix, the transducer is produced by the assembly of a plurality of planar or plate-shaped sub-arrays comprising one or two rows of vibrators. Such plate-shaped arrays are composed of piezoelectric vibrators disposed on the edge of a backing carrier member or plate acting as a backing material. Electrical connections are provided on one side or both sides of the backing plate and then the vibrators are individually connected to the electronic circuits used for signal conditioning. Such a method has the advantage of providing modular fabrication wherein the matrix is produced by the superposition of a plurality of identical sub-components. Unfortunately, one major criteria that has not been fully addressed is the dimensions of the elements of the matrix and the alignment procedure used for obtaining a final matrix array having a perfectly flat surface.

Another consideration regarding matrix array fabrication is the connection of the front electrode of each element transducer composing the matrix transducer surface. As described above, the elements of the matrix transducer should be completely split and separated in order to exhibit satisfactory acoustic radiating performance (acceptance angle). Unfortunately, the current method of making the transducer front electrode involves either disposing a sheet of metal between the piezoelectric member and the matching layer set, wherein this sheet is partially preserved after the cutting of the transducer, or using a metallized matching layer bonded to the piezoelectric member and then connecting together the remaining conductive pads, after the cutting operation, to obtain a common ground plane. In general, the matrix configuration produced by these two methods has been found to be inoperative or otherwise unsatisfactory.

More sophisticated methods have been implemented to solve the problems associated with the methods just described and such methods are disclosed in French Patent No. FR 2,756,447 to Bureau and Gelly wherein a laser cutting method is employed for slotting the matching layer deposited on the front face of the piezoelectric member. This patent discloses a transducer produced from the following steps: dicing the piezoelectric member or plate into square elements (rods) arranged in a M×N matrix, bonding a front electrode sheet onto the piezoelectric surface, bonding the matching layer in place, and selectively grooving the matching layer, using a laser beam, without damaging the electrode sheet. This method requires laser focusing beam machining which strongly modifies the characteristics of the polymer used in making the matching layer in the cutting areas. Further, because the laser focused beam is conical shaped, such grooves will be formed in a V shape, thereby decreasing the emitting/receiving surface of the transducer.

In Japanese Patent No. 8,289,398 to Nakamura and Hayashi, a plate made of piezoelectric material is divided or split into square elements or rods, and the resultant grooves are filled with a reinforced polymer. Lead wires for grounding the device are then laid on the filling polymer in the X direction, and solder pads are deposited on the wires at each crossing of four piezoelectric elements or rods so as to connect them to the lead wire. Such a method is, from a practical standpoint, very difficult to carry out, particularly when the basic array kerf or groove is less than few dozen of microns. Another disadvantage of this method concerns the solder pad deposition, which strongly impacts on the performance of an individual transducer being loaded by the mass of solder.

U.S. Pat. No. 5,855,049 to Corbett et al. describes another laser drilling method for connecting ground electrodes wherein the piezoelectric member or plate is drilled to produce an array of vias or through holes, with each via being located at the crossing of four elements of matrix. The holes or vias are then metallized, and a selective machining operation from the rear face of the piezoelectric plate provides that all of the contacts for the matrix (including those for signals and for ground) are located on the same face, thereby facilitating the further interconnection task. A disadvantage of this technique is that part of the rear electrode is then used as a ground contact, thereby proportionally reducing the polarizing surface of the vibrators and thus reducing the sensitivity of the transducer array.

SUMMARY OF THE INVENTION

An object of the present invention is to provide a method for making an interconnection means for the vibrator elements of a matrix transducer array which is relatively simple but which does not impair the transducer impulse response with acoustic artifacts due to reflections at transducer interfaces.

An additional object of the present invention is to provide a method for producing a uniform front electrode ground plane in matrix transducer devices having an isolated array construction wherein all of the vibrating elements are physically separated so as to reduce cross coupling.

In accordance with a first aspect of the invention, there is provided an ultrasonic matrix array transducer assembly including an interconnection interface member with a top surface, a bottom surface and an array of connector pads for electrically connecting the top surface to the lower surface. The transducer assembly includes flexible circuits having a first end and a second end wherein the first end is assembled to the bottom surface of the interconnection interface member and the second end is terminated by connectors for cables. The piezoelectric array of the transducer assembly is mounted on the upper surface of the interconnection interface so as to provide an electrical link between the vibrators of the piezoelectric array and the flexible circuits.

In accordance with another aspect of the invention, a method of matrix transducer array fabrication is provided which includes mounting of a piezoelectric member into a first positioning tool, and manufacturing or machining a matching layer mounted into a second positioning tool. The first and second positioning tools are parts of a positioning system designed for precisely assembling the matching layer to the array of piezoelectric vibrators of the matrix transducer array. In this second aspect of the invention, a metal sheet or metallized film is disposed on the surface of the piezoelectric member prior to the assembly thereof into the first tool.

Further features and advantages of the present invention will be set forth in, or apparent from, the detailed description of preferred embodiments thereof which follows.

BRIEF DESCRIPTION OF THE DRAWINGS

FIG. 1(*a*) is a cross sectional view of a prior art matrix transducer array construction;

FIG. 1(*b*) is a cross sectional view of another prior art matrix transducer construction wherein a conductor backing is used;

FIG. 1(*c*) is a cross sectional view of a prior art direct wiring matrix transducer construction;

FIG. 1(*d*) is a cross sectional view of a prior art matrix array transducer assembly wherein an integrated circuit device is used to provide connection with a piezoelectric member as well as the driving electronics;

FIG. 1(*e*) is a perspective view of a prior art matrix array produced by the assembly of a plurality of single sub-array substrates;

FIG. 2 is a cross sectional view of a matrix transducer array in accordance with a first aspect of the invention;

FIG. 3(*a*) is a front view of the interconnection interface carriers (IIC) member of the transducer array of FIG. 2;

FIG. 3(*b*) is a cross sectional view of the interconnection interface member of FIG. 3(*a*);

FIG. 3(*c*) is a cross sectional view of one embodiment of the IIC device of the array of FIG. 2;

FIG. 3(*d*) is a cross sectional view of the IIC device of FIG. 3(*c*) according to a second embodiment;

FIG. 6(*b*) is a view similar to FIG. 6(*a*) showing a further step in the manufacturing process;

FIG. 6(*c*) is a cross sectional view of a grooved matching layer set with its associated tooling;

FIG. 8 is a cross sectional view of a complete matrix array transducer according to a first embodiment;

FIG. 9 is a cross sectional view of a matrix array transducer according to a second embodiment;

FIG. 10 is a cross sectional view of a matrix array transducer according to a third embodiment;

FIGS. 11(*a*) to 11(*g*) are cross sectional views of various steps in a method for producing an IIC device in accordance with another embodiment of the invention;

FIG. 12 is a top plan view of an IIC surface including conductive areas;

FIG. 13 is a longitudinal cross sectional view of a single cell of an IIC device produced by the method of FIGS. 11(*a*) to 11(*g*);

FIG. 14 is a transverse cross sectional view of the IIC device;

DETAILED DESCRIPTION OF THE PREFERRED EMBODIMENTS

Figure 4:
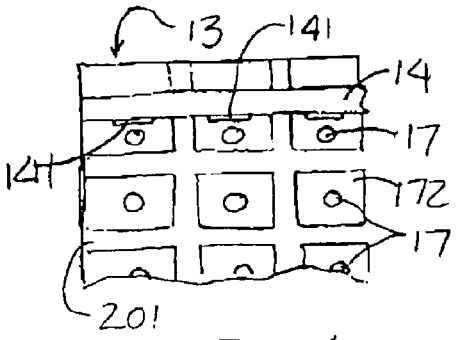
FIG. 4 is a front view of the IIC device of FIG. 3(*a*) with grooves therein and a mounted flexible circuit.

As indicated above, the present invention particularly addresses the methods of individually electrically connecting the elementary piezoelectric vibrators that comprise a matrix array transducer. The invention also addresses the methods of making a uniform and continuous ground electrode in such a matrix array based on a performance driven fabrication approach which incorporates essential conditions necessary for quality transducer construction.

Although the two aspects of the invention described above are disclosed together here, one or the other aspect can be used separately without departing from the spirit of the invention. Moreover, the descriptive drawings are provided of exemplary embodiments and are neither to scale nor exhaustive. For simplicity of understanding, the description of the present inventions employs the terms of "top surfaces" or "top faces" to designate the face of plate components which is oriented towards the direction of propagation and the terms of "bottom surfaces" or "bottom faces" to designate the face which is oriented towards the back or rear side of transducer. The terms "matrix," "matrix array" and "matrix array transducer" are used at different places throughout without any distinction therebetween and all designate a transducer having elements arranged in a M×N matrix configuration. Further, the term "vibrator" is sometimes used for designating elementary piezoelectric transducers which comprise the matrix.

Before considering specific embodiments of the invention, reference is made to the prior art devices depicted in FIGS. 1(*a*) to 1(*e*), wherein different examples of prior art matrix design are shown. For simplicity of explanation, the prior art devices shown in all the above figures (FIGS. 1(*a*) to 1(*e*)) generally comprise a piezoelectric member 1, a matching layer set 2, a backing member 3, an interconnection means or circuit 4 and optionally, connecting wires 5 (FIG. 1(*c*), solder pads 61 (FIG. 1(*d*)) and electronic circuits (not shown). FIGS. 1(*a*) to 1(*e*) are presented simply to show different arrangement of these basic components or elements and the content thereof is briefly described above in the previous section.

First Embodiment

Turning to a first preferred embodiment of the invention, in general, in accordance with this embodiment, a matrix ultrasonic device is provided with a piezoelectric member sandwiched between matching layers and a backing member and including interconnection means. In this embodiment, the piezoelectric member and matching layers are both divided or split into independent vibrators having an acoustic discontinuity with respect to their adjacent neighbors. A continuous ground plane is also provided on the front face of the piezoelectric member thereby achieving an efficient electromagnetic interference barrier between the transducer and the external environment.

Referring to FIG. 2, there is shown a matrix array transducer equipped with an interconnection means according to a first aspect of the invention. The matrix of FIG. 2 includes a piezoelectric member 7 which can be made up of polycrystalline ceramics such as PZT, PMN-PT, polymer-ceramic composite, single crystals or the like. The piezoelectric member 7 is provided either as a monolithic layer or in a stacked structure (i.e., a multilayer structure) to enhance the capacitance behavior of the vibrators. In the stacked structure construction, the thickness of the vibrators is obtained by laminating a plurality of discrete thin piezoelectric sheets each having an equal sub-thickness and sub-electrodes. Furthermore, the stacked vibrators can operate as a serial or parallel assembly. However, with respect to the matrix vibrator specifications, a parallel stacked assembly is presently preferred. The inherent improvement in vibrator capacitance will, therefore, greatly benefit the energy transfer coefficient of the system, thereby increasing the sensitivity and bandwidth of transducer. For the sake of simplicity, the description of the preferred embodiment will relate only to a monolithic transducer. However, the advantages of the use of stacked piezoelectric members in making the invention will be obvious to one skilled in the art.

In the matrix assembly of FIG. 2 as hereinabove mentioned, the piezoelectric member 7 is a plate or planar member with metal electrodes on its opposite surfaces to provide, respectively, an active or "hot" electrode 8 and a common ground electrode 9. Suitable materials for making the electrodes 8 and 9 are advantageously selected from the group consisting of highly ductile metals such as cooper, silver, gold or aluminum. Further, a pre-adhesion coating (not shown) is recommended to increase the mechanical resistance of the electrodes 8 and 9. The top surface of piezoelectric member 7 is affixed to a first matching layer 10 that is specifically designed for maximizing the acoustic energy transfer coefficient between the transducer and the examination medium. However, a second matching layer 11 is usually recommended to optimize the bandwidth of transducer. In general, the first and second matching layers 10 and 11 respectively exhibit acoustic impedances z1 and z2 related in a manner such that z1>z2, and are governed by the following expression: zc>zc1>z2>zm, where zc is the acoustic impedance of the piezoelectric member and zm is that of the propagation medium. Optionally, a focusing lens, indicated at 12, may be provided on the surface of the outermost matching layer 11 in order to focus the ultrasonic energy.

Piezoelectric member 7 has, on its bottom surface, an interconnection means in the form of an Interconnection Interface Carrier (IIC) 13 which is bonded to the "hot" electrode 8 of the piezoelectric member 7. This bonding operation is carried out with appropriate tooling wherein the piezoelectric member 7 is firmly maintained in place. Guidance is also provided for the assembly of the IIC 13 to the surface of the piezoelectric member 7. A nonconductive resin is preferably used for the bonding operation and resins such as Epotech 301 or the equivalent are suitable candidates.

This IIC device 13 acts as an intermediate assembly or device between the piezoelectric member 7 and the interconnect circuits of the transducer. Special care should be paid in making this section of the transducer in order to insure optimized performance of the resultant construction. Considering IIC 13 in more detail, the IIC 13 includes a plurality of through holes or vias 17 which electrically connect the electrode 9 of the piezoelectric member 7 and the bottom surface 131 of the IIC device 13. Grooves 133 are provided in the bottom surface 131 of the IIC device 13 which act as a receptacle for flexible (flex) circuits 14. Finally, solder connections (solder fillets) 15 connect conductive tracks of the flexible circuits 14 to the corresponding solder pad areas of the IIC device 13. The basic matrix array transducer is, therefore, connected row by row to the flexible circuit 14 through the IIC device 13. The soldering operation can be performed either manually or automatically, using, for instance, a conventional hot-air method or a soldering iron. The transducer so obtained can also be connected to coaxial cables (not shown) by connectors 19 provided on the distal end of the flexible circuits 14.

FIGS. 3(*a*) and 3(*b*) show further details of the IIC device 13 shown in FIG. 2. As best seen in FIG. 3(*b*), the IIC device 13 is composed of a plate or planar member 20 which is preferably made from either an insulated polymer, a particle filled polymer, a glass reinforced resin, a ceramic or a composite. In the preferred embodiment of the invention, plate 20 comprises an insulated, fiber reinforced, particle filled resin. Such a mixture can be obtained from the mixing of polyurethane or epoxy resins with inorganic fibers and plastic air bubbles. The mixture is then poured into a mold (not shown) having a shape corresponding to the dimensions of plate 20.

Plate 20 preferably has dimensions in exact proportion to those of the piezoelectric member 7 in order to facilitate the X-Y alignment of the two components. The thickness of plate 20 is defined in accordance with the transducer frequency but preferably ranges from 0.5 mm to 1 mm. Preferably, the thickness of plate 20 is selected to be an odd multiple of one quarter of the transducer wavelength in order to minimize reflection at interface, and the acoustic impedance of plate 20 is, in parallel, determined based on common considerations for matching layers.

In the next step, holes 17, corresponding to vias 17 shown in FIG. 2, are then drilled through the thickness of plate 20, thereby forming an array of holes or vias wherein the distribution of the holes 17 mimics that of the related matrix. The drilling operation for holes 17 can be carried out mechanically or by using laser drilling techniques. In the latter case, laser types that can be used for this operation are preferably selected from the group consisting of Yag lasers, Excimer Lasers or the like. The laser beams produced by such lasers are controlled with respect to the output power and the degree of focusing thereof, so as to minimize faults in the hole geometry. The diameter of holes 17 should also be determined according to the pitch of the transducer array to avoid the potential occurrence of short circuits caused by the misalignment of opposing contact patterns, and an excessive reduction of the remaining conductive surface surrounding the hole aperture. Typically, the diameter of the holes 17 should be no more than one half of the pitch of the array.

Once the drilling operation is complete, plate 20 is wholly metallized, and every surface of the plate must be coated by the electrode metal. Techniques suitable for such metal deposition include evaporation, sputtering, and electrolytic and chemical metallization methods. In particular, electrolytic and chemical plating methods are well suited for the metallization of a complex surface. The thickness of the metal coating should be about 5 $\mu$m or less, and materials such as cooper, nickel, aluminum, silver and gold are good candidates for this application.

Upon the completion of the metallization process, the edges of plate 20 are abraded to remove the metal thereof so that the remaining opposing electrodes 171 and 172 (see FIGS. 3(*a*) and 3(*b*)) on the opposed surfaces are, therefore, connected to each other by the metallized holes or vias 17. FIG. 3(*c*) shows a cross-sectional view of one of the holes 17 in plate 20. As shown, holes 17 have chamfers 173 around the edges of the opposite ends. The metallization coating covers the whole surface of plate 20 including the interior surface of holes 17 and chamfers 173 to form the top conductor surface or electrode 172 and the bottom conductor surface or electrode 171. At this stage, the bottom conductor 171 is spared from any cutting or grooving. The holes 17 are afterwards filled with a potting material 174 which is advantageously composed of the same material or materials as are used to make plate 20 so as to obtain a homogenous plate. The filling operation should be performed with care so as to not overfill onto the surfaces of IIC device 13, and an adhesive film can be advantageously used at the bottom face of IIC device 13 for the filling operation. The chamfers 173 help ensure that the metal coating is complete since such may not be the case where there are sharp edges. However, this is an optional feature.

FIG. 3(*a*) also shows the grooves 201 provided on the top surfaces of plate 20. In practice, grooves 201 are only useful in a single direction of the matrix for maintaining the flexible circuits 14 in place during the soldering operation. However, it has been shown in the literature that an improvement in acoustic performance is observed when grooves 201 are provided in both the X and Y directions. As clearly shown in FIG. 3(*a*), grooves 201 split the top electrode of plate 20 in individual square areas forming the conductive surface or electrode 172 that surround the opening aperture of hole 17 illustrated in FIG. 3(*a*). The depth of grooves 201 is selected to combat the generation of surface waves in the plate 20 such as are induced by vibrations from the transducers or vibrators. Usually, and for transducer frequencies in the range from 2 to 5 MHz, a 100 $\mu$m to 300 $\mu$m depth is suitable. Optionally, the dicing operation for grooves 201 can be avoided or omitted if the piezoelectric plate 7 is to be cut through at a later stage in the operation. As shown in FIG. 3(*d*), further grooves 202 may be provided in the opposite surface of plate 20 as is described in more detail below.

FIG. 4 shows a front view of IIC device 13 including a flexible circuit 14 having conductive tracks 141 provided on one side. The assembly of circuit 14 is straightforward and the conductor tracks 141 are aligned in front of the corresponding conductive surface. Low temperature solder paste is deposited along with the intersection of the flexible circuit 14 and the elements to be soldered. In providing soldering of the circuit 14 to be soldered to the IIC device 13, hot air equipment is well suited for the task and, indeed, if a small amount of liquid solder paste is deposited, the passage of a hot air flux will cause tracks 141 to be soldered to the corresponding conductive surface without operator intervention. The circuits 14 are then mounted in this way on the IIC device 13, one after the other, from one side of the array to the other side, in order to complete the interconnection operation. It is noted that the presence of IIC device 13 between the piezoelectric member 7 and the circuits 14 will also act to provide thermal insulation to protect the piezoelectric material from the risk of thermal depolarization.

The width of grooves 201 is determined based on the thickness of flexible circuits 14 and the depth thereof is chosen to be about 50% of the thickness, in order to ensure that the remaining portion of the plate material is capable of maintaining the IIC device 13 sufficiently firmly to permit further manipulation thereof during the fabrication process.

Figure 5:
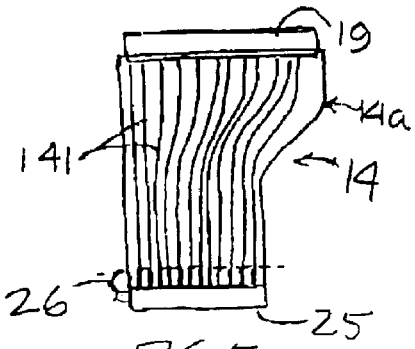
FIG. 5 is a side elevational view of the flexible circuit of FIG. 4.

The flexible circuit 14 is better shown in FIG. 5, wherein the circuit is illustrated as having a single face metallized flexible film 14*a* containing tracks or traces 141 thereon. The film 14*a* is terminated on one side by a connector 19 adapted to be connected to coaxial cables, and on the other side by a portion 25 which is free of conductive traces 141, and which is designed to be inserted into grooves 201. As illustrated in FIG. 5, tracks 141 extend from one side to the other in parallel fashion and a cover layer (not shown) can be provided to avoid track oxidation. However, tracks 141 are free of any cover layer in an area indicated at 26 to enable a soldering operation to be carried out. In area 26, conductive tracks 141 of circuit 14 must have same pitch than those of holes 17 of the IIC device 13, meaning that pitch of tracks 141 can be increased or expanded at the opposite side of the circuit 14 so as to fit the connector specifications.

The mounting of circuits 14 requires alignment thereof with respect to the IIC device 13, so that the width of a flex circuit 14 is preferably selected to equal that of the IIC 13, and, inherently, the alignment of flex circuit 14 is greatly facilitated. Furthermore, flex circuits 14 are preferably mounted onto the IIC device 13 from one side to the other, and one after the other, in the same manner. Accordingly, the first flex circuit 14 is assembled in the first groove 201, and the solder paste is then deposited along the junction between tracks 141 and pads 172 (see FIG. 4). Heating of this region will cause tracks 141 to be soldered to their corresponding pads 172, and thus the soldering operation required is quite straightforward. A second flex circuit 14 is then similarly mounted and the process is repeated as previously described, and so on, for the other flex circuits 14.

Once the assembly of IIC device 13 on the bottom face of the piezoelectric member 7 is completed, the sandwich so obtained is turned upside down and, through dicing of the piezoelectric member 7, the surface of piezoelectric member 7 is split into a plurality of vibrators. The dicing operation is designed to completely penetrate the thickness of the piezoelectric member 7 and partially penetrate the IIC 13 underneath. This operation provides formation of the grooves 202 mentioned above and shown in FIG. 3(*d*).

Referring again to FIG. 2, this figure shows the piezoelectric member 7 cut through by groove 18 which is continued to form groove 202, i.e., groove 202 in IIC 13 is formed when groove 18 is formed during the dicing operation described above. Grooves 18 and 202 can either be air-filled so that no additional processing is required, or can be filled with a flexible resin or the like in order to stiffen or strengthen the transducer plate. Filling resins, such as Ecogel 1254 from Emerson & Cumming and silicon rubbers, are good candidates.

At this stage, the vibrators of the matrix transducer are all separated or spaced from each other. As previously described, the entire thickness of piezoelectric member 7 is cut through, and only the "hot" electrodes 8 of the piezoelectric member 7 are connected to conductive surface 172 of the IIC device 13. In this regard, the front ground electrode 9 remains separated and thus must be connected to the ground plane of system.

The next step involves a ground connection method wherein an intermediate metallized film is disposed between the front face of the piezoelectric member 7 and the stack of matching layers 10 and 11. This method further provides individual matching layer portions for every vibrator of the array. This method greatly improves the acoustic behavior of the elementary vibrators especially with respect to the acceptance angle and impulse response of the transducer.

Figure 6A:
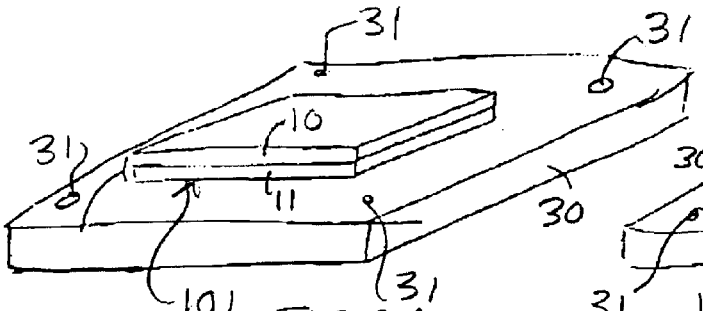
FIG. 6(*a*) is a perspective view of a matching layer and associated matching layer tooling.
Figure 6B:
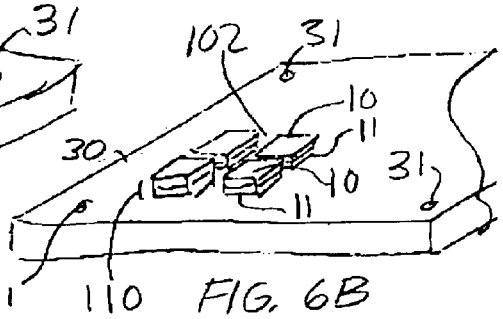
Figure 6C:
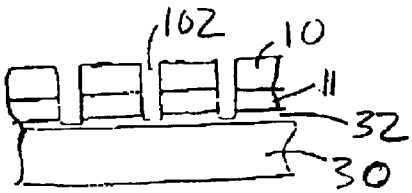

Referring to FIG. 6, there is shown a matching layer set 101 which comprise a first matching layer 10 and a second matching layer 11 laminated together. The set 101 is secured to an optically transparent carrier plate 30 which is provided with guiding holes 31 disposed at the corners of the carrier plate 30. The bonding of the layer set 101 preferably uses a UV sensitive resin system wherein the bonding operation is carried out conventionally, and the exposure of the cured resin to the UV light source results in cancellation of the adhesion capability of the resin, i.e., the resin loses its adhesiveness, so that matching layer set 101 can then be removed from its support.

It is noted that the orientation of the matching layer set on the carrier 30 is a sensitive aspect in the fabrication process. The external side of the second matching layer 11 faces the surface of carrier 30 and then, the matching layer set 101 is precisely positioned on the carrier 30 with respect to the positions of guiding holes 31. The position of the matching layer set 101 on carrier 30 is determined in such a manner as to obtain perfect alignment with regard to the front face of the piezoelectric member 7 when the tooling is assembled. This operation is ideally performed using precision assembly tooling which comprises a first part that houses the piezoelectric transducer assembly and a second part that mates with the first one and has the matching layer portions 10 and 11 attached thereto.

Referring to FIG. 6(*b*), once the curing of bonding resin is complete, the matching layer set 101 is then diced by orthogonal cuts 102 into individual portions 110 each having dimensions approximately those of the piezoelectric vibrator. The cuts 102 performed in the X and Y directions on the matching layer set 101 extend partially into the thickness of resin layer 32 as shown in the cross sectional view of FIG. 6(*c*). The array of individual portions 110 and orthogonal cuts 102 form a structure having the same pitch than that of piezoelectric array so the two can be perfectly superimposed one on the other. However, the kerf spaces formed between portions 110 or cuts 102 can have a width different than that of the grooves 18 of the piezoelectric member 7 and this difference in width can be chosen in such a manner as to optimize the cross-coupling level affecting the matching layer thickness.

Figure 7:
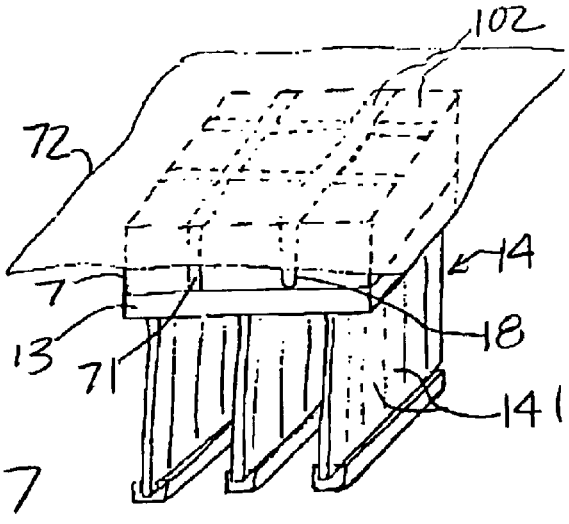
FIG. 7 is a perspective view of the matrix transducer array of FIG. 2 prior to matching layer assembly.

In the next step, the assembly of piezoelectric member 7 and matching layer set 110 is carried out. The piezoelectric sandwich previously obtained is next mounted in the assembly tooling (not shown) so that the piezoelectric device is properly oriented and positioned. This tooling, which is conventional, enables the surface of piezoelectric member 7 to be disposed parallel to the surfaces of the matching layer portions to be further assembled. As shown in FIG. 7, a flexible resin material 71 is used to fill the grooves 18 in the piezoelectric sandwich. Thereafter, a thin metal sheet or a metallized polyamide film, designated as a front electrode collector and denoted 72, is affixed to the surface of piezoelectric sandwich. This operation can be carried out separately prior to the assembly of matching layer set 101 or in combination of the bonding of matching layer set 101, without any impact on the performance of the transducer or on the basic method of fabrication.

Commonly, the carrier 30, equipped with matching layer portions 110, is then assembled to the piezoelectric member 7 over the front electrode collector 72. Bonding is carried out with a resin material 111 such as flexible epoxies or polyurethanes. Further, grooves or kerfs 102 can then be filled by the same resin, thereby simplifying the manufacturing process. Otherwise, grooves or kerfs 102 are to be filled with resin 111 prior to the assembly thereof to the piezoelectric member.

Referring to FIG. 8, there is shown a cross-sectional view of a complete assembled matrix transducer wherein an IIC 13 supports a piezoelectric member 7 which has been diced into vibrators 73 which are separated by resin 71. The vibrators 73 include front electrodes 8 and rear electrodes 9. A front electrode collector 72 is disposed over the surface of piezoelectric member 7. Matching layers 10 and 11 are disposed outermost of the sandwich construction and resin 111 fills the kerfs. Resins 71 and 111 may be chosen among many different types having different Poisson coefficients. In this regard, a refinement of the transducer performance can be achieved based on the selection of a particular resin having the desired characteristics. With respect to the difference in impedance between the piezoelectric and matching layer materials, the filling resins 71 and 111 may be advantageously selected to have different characteristics in order to optimize the acoustic behavior of each material.

The electrode collector 72 disposed at the interface of piezoelectric member 7 and matching layer 10 is chosen so that the total thickness thereof is as thin as possible so as to not disturb the energy transmission in the direction of the interrogated medium. For example, a metallized film of less than 7 $\mu$m thick is perfectly suited for applications in the frequency range of 2–5 MHz. Films such as cooper coated polyamide (0.5/5) (0.5 $\mu$m Cu/5 $\mu$m Polyamide) or single cooper sheet are good candidates.

At this stage, the front face of the transducer as shown in FIG. 2 can be optionally provided with a silicon focusing lens 12. The convex shape of lens 12 favors contact between the transducer and the patient for ultrasound transmission. If the lens material is chosen with a sound velocity comparable to that of the propagation medium, no focusing effect is encountered and such material can be used as protective layer for the transducer.

Second Embodiment

The second preferred embodiment of the transducer assembly of the invention is essentially the same as the first preferred embodiment except for the IIC device 13. FIGS. 11(*a*) to 11(*g*) illustrate various steps in a method for making the IIC device in accordance with a preferred embodiment of the invention. As shown in FIG. 11(*a*), a plate or member 40 is initially provided in a planar shape. Plate 40 is made of an insulating material such as a resin, ceramic or any other inorganic material. Preferably plate 40 is obtained from the molding of a particle filled resin such as a glass reinforced epoxy or a fiber reinforced epoxy.

As shown in FIG. 11(*b*), grooves 41 are provided in one main surface of plate 40, having a pitch p and a width a, as indicated. It is important to note that the pitch p is equal to that of the transducer array and that the width a is determined to be significantly smaller than the aperture of the transducer vibrator to be attached. In a preferred embodiment, a ratio of 50% is recommended.

As shown in FIG. 11(*c*), the grooved plate 40 is metallized with a metal layer or film 42 which may be copper, aluminum, nickel or gold. The thickness of the metal layer 42 preferably does not exceed a few microns so as to not impact on the acoustic impedance of the final device.

Next, a resin filler 43 is then poured in the grooves 41 as shown in FIG. 11(*d*) and indicated schematically by pouring cup C. Preferably, the resin filler 43 is selected from the group of polymers that exhibit approximately same acoustic characteristics than those of plate 40.

Referring to FIG. 11(*e*), which shows the plate 40 as previously metallized and with the resin poured into grooves 41, a parallel grinding operation is carried out on the main surfaces of plate 40 in a manner such as to produce vias formed by a remaining portion of metal layer 42 surrounding resin filler 43 so that resin is now in the form of rods.

As shown in FIG. 11(*f*), in the next step, metallization layers 421 connect all metal layers 42 that have been formed and remain in the thickness of plate 40. The thickness of metallization layers 421 is selected in the same manner as the thickness of layers 42.

Finally, as shown in FIG. 11(*g*), plate 40 is grooved in both its surfaces to produce grooves 44 and 45 and to thus form conductive pads 451 and 441 which have a pitch p and are located one in front of the other, i.e., in an opposed relation as shown. The grooves 45 and 44 have a width significantly smaller than the distance p-a with "p" and "a" being as defined in FIG. 11(*b*). Further, grooves 44 and 45 do not need to have the same width. In this regard, the width and depth of grooves 45 are defined or determined according to the kerf of the final array and the level of surface waves to be combated, while the grooves 44 should be determined with respect to the thickness of the flexible circuits to be inserted therein.

Referring to FIG. 12, which is a plan view from beneath plate 40 of FIG. 11(*g*) and shows the front face of plate 40, there is shown the conductive pads 441, the metal vias 42 (shown in dashed lines) and grooves 44. Pads 441 are spaced each other by a pitch p.

FIG. 13 shows the details of a single via 42 formed in plate 40 and including conductive pads 441 and 451.

Similarly, FIG. 14 shows a cross sectional view corresponding to a single element of the array. The hatched area defined by the large square represents the surface electrode of an element of the array, while the dashed line square corresponding to pad 441 indicates the surface of the conductive pad of the final IIC device. FIG. 14 also shows the metal via 42 surrounding the resin rod 43. FIG. 14 indicates the large position tolerance that can be accepted by an IIC device manufactured according to the embodiment shown in FIGS. 11(*a*) to 11(*h*), 12 and 13.

As described above in connection with the first and second embodiments, the transducer of these embodiments is mechanically divided into individual vibrators that are linked together by a filling resin having more flexibility than the piezoelectric material itself. As a consequence, a transducer device built in this way can be caused to bend or otherwise be shaped to have a curved surface. It is noted that the basic transducer assembly is complete when in a flat shape and any bending operation is to be performed afterward, if desired. The method here described is capable of providing a large variety of transducer curvatures based on the same basic matrix device.

Figure 15:
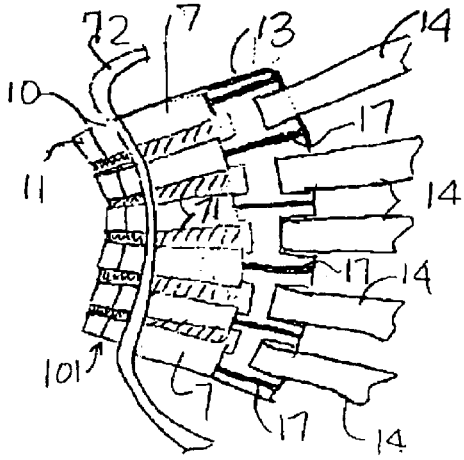
FIG. 15 shows a cross sectional view of concave matrix array transducer.
Figure 16:
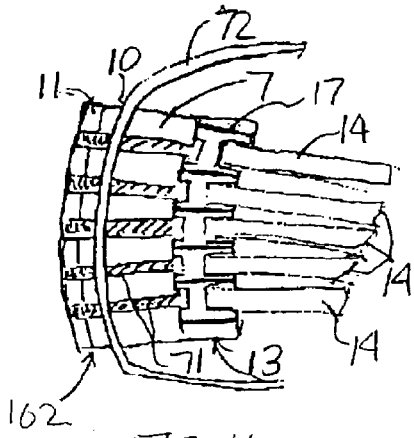
FIG. 16 shows a cross sectional view of convex matrix array transducer.

Referring to FIGS. 15 and 16 wherein corresponding elements have been given the same reference numerals, matrix array transducers are shown which respectively have a concave shape and a convex shape. The bending of transducer may be performed in a temperature processing operation where the entire transducer is heated to a temperature of about 60° C. The transducer is then disposed in a bending tool (not shown) that is also at the same temperature, and pressure is progressively exerted on the opposite face of the transducer. This pressure is maintained until the transducer perfectly fits the curved surface of the bending tool. Preferably, the front face of the transducer faces and is brought into contact against, the curved surface of the bending tool. Once the transducer is shaped, the temperature is then decreased to reach an ambient value and the pressure is still maintained for some hours. A potting compound is then provided in the rear space defined by the array and, if possible, around the entire array to stiffen the shaped array.

Figure 17:
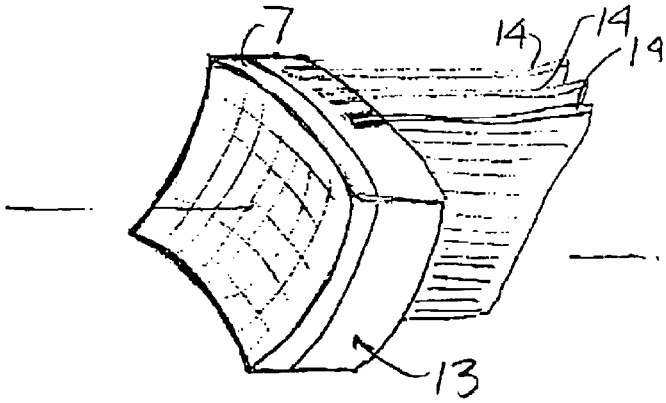
FIG. 17 is a perspective view of the concave matrix transducer of FIG. 15.
Figure 18:
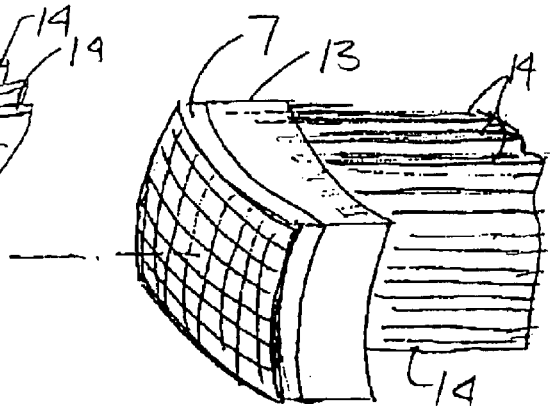
FIG. 18 is a perspective view of the convex matrix transducer of FIG. 16.

FIGS. 17 and 18 are perspective views of concave and convex matrix array transducers produced by the method described above.

Third Embodiment

Referring to FIG. 9, a third preferred embodiment of the invention is shown wherein corresponding elements have been given the same reference numerals that were used previously. The matrix array transducer of FIG. 9 includes a piezoelectric member 7 sandwiched between a IIC device 13 and matching layers 10 and 11 located forwardly thereof. The piezoelectric member 7 is shaped in such a manner as to provide a M×N matrix array arranged on its surface. An electrode 8 is split into individual square electrodes corresponding to an elementary surface of each vibrator comprising the transducer surface. The front face of piezoelectric member 7 is affixed or secured to matching layers 10 and 11 which are laminated together to form a set of matching layers wherein grooves 103 are formed beforehand and a filler material 112 filled into groove 103. The IIC device 13 is affixed to the rear face of the piezoelectric member 7 and has flexible circuits 14 soldered to its rear face, as illustrated. The method here described provides a continuous ground electrode 9, thereby simplifying the transducer assembly.

The IIC device 13 of this embodiment is similar to those previously depicted in FIGS. 3(*a*) and 3(*b*), with the constructional details shown in FIG. 3(*d*). In this regard, FIG. 3(*d*) shows a cross sectional view of such an IIC device having corresponding grooves 202 formed in the surface thereof facing the piezoelectric member 7. Preferably, grooves 202 are aligned with the pattern of grooves 201 in the opposing face of the device as shown in FIG. 3(*d*). The depth of grooves 202 is selected so that grooves 202 are spaced from grooves 201 and, preferably, so as to preserve a substantial material thickness between the bottoms of the grooves. Similarly, the depth of grooves 201 should not exceed a wavelength penetration so as to provide the member 20 with surface wave (Rayleigh waves) cancellation. Additionally, grooves 202 provide the face of IIC device 13 with conductive pads 172 which are, in turn, connected to the electrodes of elementary vibrators.

During the assembly of the IIC device 13 wherein device 13 is brought into engagement against the piezoelectric member, care should be taken to avoid misalignment between grooves 202 of the IIC 13 and the groove pattern of the piezoelectric member 7. This can be readily achieved if piezoelectric member 7 and IIC device 13 have been shaped identically with respect to the surface dimensions thereof.

As a next step the matching layer formed by layers 10 and 11 is affixed to the front face of the piezoelectric member 7. Similarly to the description above, the grooves 103 should be aligned with the grooves 202.

To complete the transducer assembly, the flexible circuits 14 are then mounted on the rear face of the IIC 13 and a soldering operation is carried out provided, according to that described above in connection with the first embodiment.

Referring to FIG. 10, there is shown a matrix transducer according to a fourth embodiment of the invention. This embodiment is similar to the third embodiment described previously except the matching layer set formed by matching layers 10 and 11 has grooves 103 extending inwardly from the external face towards the piezoelectric member 7. A filler material 102 is also provided in grooves 103 and, preferably, alignment is provided between matching layer grooves 103 and the grooving of the IIC device 13.

The matrix transducer according to the fourth embodiment is even more cost effective than the previous embodiment with respect to manufacturing costs. In this regard, in this embodiment, the sandwich of piezoelectric member 7, IIC device 13 and matching layers 10 and 11 is laminated prior to cutting operation that forms grooves 103 thereby enabling closer tolerances to be achieved in the positioning of different components to be assembled. The depth of grooves 103 is then determined based on the total thickness of the matching layer set formed by layers 10 and 11, and preferably, the depth of the cuts will be in the range of 70–95% of the total thickness of the set of matching layers. However, even a 100% cutting depth may be considered if this is permitted by the precision of the cutting equipment used, and such can still be achieved without sacrificing the perfect planarity of the piezoelectric plate 7. In any case, the electrode 9 must not be completely cut through. A matrix array transducer manufactured according to this method exhibits performance characteristics sufficient for a standard quality imaging device and can be used in low-range and mid-range systems where cost is a prime concern.

Although the invention has been described above in relation to preferred embodiments thereof, it will be understood by those skilled in the art that variations and modifications can be effected in these preferred embodiments without departing from the scope and spirit of the invention.

What is claimed:

1. A method for providing a matrix array ultrasonic transducer with an integrated interconnection means, said method comprising:

providing a piezoelectric member comprising a plurality of individual elemental transducers arranged in M×N matrix configuration and having a rear face;

attaching an interconnect interface device to the rear face of the piezoelectric member, said interconnect interface device having contact mapping arranged in the same M×N matrix configuration as the individual elemental transducers at a front face thereof and guide means for guiding attachment of printed circuits to a rear face thereof; and attaching a plurality of printed circuits to the guide means of the interconnect interface device.

2. A method according to claim 1 further comprising:

providing said interconnect interface device in the form of an insulator member having dimensions matching corresponding dimensions of the piezoelectric member;

drilling holes in said insulator member to form an array of said holes therein of the same arrangement as the elemental transducers of the piezoelectric member;

providing metallization of the entire insulator member;

filling said holes of said insulator member with a resin filling; and producing grooves in at least one face of the insulator member for receiving said printed circuits.

3. A method according to claim 1 further comprising:

providing said interconnect interface device in the form of an insulator member having dimensions matching corresponding dimensions of the piezoelectric member and having a transverse thickness and opposed faces;

performing a first grooving operation to produce grooves in the insulator member having a depth of at least 80% of the transverse thickness of said insulator member;

performing a first metal deposition wherein a metal is deposited on all surfaces of said insulator member;

filling said grooves with a resin;

performing a grinding operation on both opposed faces of the insulator member to provide a remaining metal deposition on said opposed faces of the insulator member;

performing a second metal deposition wherein a metal is deposited on said both faces of the insulator member so as to be connected to the metal deposited by said first metal deposition remaining after the grinding operation; and performing a second grooving operation, in X and Y directions, on at least one face of the said insulator member to form isolated metal areas on said at least one face.

4. A method according to claim 1 further comprising:

heating a completed transducer comprising said piezoelectric member, said interconnect interface device and said printed circuits, together with a curved bending tool, to a temperature between 60° and 80° C.;

applying progressive pressure to an external face of the transducer;

maintaining the pressure applied to the transducer until a surface curvature is provided which fits that of the curved bending tool;

decreasing the temperature to ambient;

maintaining the transducer under pressure for an additional time period;

releasing the pressure; and potting the rear facing face of the transducer.

5. A method according to claim 4 further comprising potting a surrounding space adjacent to said rear facing face.

6. A method according to claim 1 wherein said transducer array comprises a linear array wherein either M or N is equal to 1.

7. A method according to claim 6 wherein said transducer array comprises a curved linear array.

8. A method according to claim 1 further comprising dicing piezoelectric substrate into said piezoelectric member comprising said elemental transducers arranged in said M×N matrix configuration;

dicing associated matching layers of a matching layer set to produce a matrix arrangement of matching layer elements;

providing a thin film of a conductive material on a front surface of the piezoelectric member;

bringing the diced matching layer into engagement with the piezoelectric member to produce an assembly thereof while providing alignment of the matrix arrangement of the elemental transducers and the matrix arrangement of the matching layer elements; and curing said assembly.

9. A method for providing a matrix array ultrasonic transducer with an integrated interconnection means, said method comprising:

providing a piezoelectric member comprising a plurality of individual elemental transducers arranged in M×N matrix configuration and having a rear face;

disposing an interconnect interface device at the rear face of the piezoelectric member; and attaching a plurality of printed circuits to the interconnect interface device so as to enable connection of the piezoelectric member to an external cable, said method further comprising:

providing said interconnect interface device in the form of an insulator member having dimensions matching corresponding dimensions of the piezoelectric member;

drilling holes in said insulator member to form an array of said holes therein of the same arrangement as the elemental transducers of the piezoelectric member;

providing metallization of the entire insulator member;

filling said holes of said insulator member with a resin filling; and producing grooves in at least one face of the insulator member for receiving said printed circuits.

10. A method for providing a matrix array ultrasonic transducer with an integrated interconnection means, said method comprising:

providing a piezoelectric member comprising a plurality of individual elemental transducers arranged in M×N matrix configuration and having a rear face;

disposing an interconnect interface device at the rear face of the piezoelectric member; and attaching a plurality of printed circuits to the interconnect interface device so as to enable connection of the piezoelectric member to an external cable;

said method further comprising:

providing said interconnect interface device in the form of an insulator member having dimensions matching corresponding dimensions of the piezoelectric member and having a transverse thickness and opposed faces;

performing a first grooving operation to produce grooves in the insulator member having a depth of at least 80% of the transverse thickness of said insulator member;

performing a first metal deposition wherein a metal is deposited on all surfaces of said insulator member;

filling said grooves with a resin;

performing a grinding operation on both opposed faces of the insulator member to provide a remaining metal deposition on said opposed faces of the insulator member;

performing a second metal deposition wherein a metal is deposited on said both faces of the insulator member so as to be connected to the metal deposited by said first metal deposition remaining after the grinding operation; and performing a second grooving operation, in X and Y directions, on at least one face of the said insulator member to form isolated metal areas on said at least one face.

11. A method for providing a matrix array ultrasonic transducer with an integrated interconnection means, said method comprising:

providing a piezoelectric member comprising a plurality of individual elemental transducers arranged in M×N matrix configuration and having a rear face;

disposing an interconnect interface device at the rear face of the piezoelectric member; and attaching a plurality of printed circuits to the interconnect interface device so as to enable connection of the piezoelectric member to an external cable;

said method further comprising:

heating a completed transducer comprising said piezoelectric member, said interconnect interface device and said printed circuits, together with a curved bending tool, to a temperature between 60° and 80° C.;

applying progressive pressure to an external face of the transducer;

maintaining the pressure applied to the transducer until a surface curvature is provided which fits that of the curved bending tool;

decreasing the temperature to ambient;

maintaining the transducer under pressure for an additional time period;

releasing the pressure; and potting the rear facing face of the transducer.

12. A method for providing a matrix array ultrasonic transducer with an integrated interconnection means, said method comprising:

providing a piezoelectric member comprising a plurality of individual elemental transducers arranged in M×N matrix configuration and having a rear face;

disposing an interconnect interface device at the rear face of the piezoelectric member; and attaching a plurality of printed circuits to the interconnect interface device so as to enable connection of the piezoelectric member to an external cable;

said method further comprising:

dicing a piezoelectric substrate into said piezoelectric member comprising said elemental transducers arranged in said M×N matrix configuration;

dicing associated matching layers of a matching layer set to produce a matrix arrangement of matching layer elements;

providing a thin film of a conductive material on a front surface of the piezoelectric member;

bringing the diced matching layer into engagement with the piezoelectric member to produce an assembly thereof while providing alignment of the matrix arrangement of the elemental transducers and the matrix arrangement of the matching layer elements; and curing said assembly.

* * * * *